US007575805B2

(12) United States Patent
Achilles et al.

(10) Patent No.: US 7,575,805 B2
(45) Date of Patent: Aug. 18, 2009

(54) POLYCRYSTALLINE DIAMOND ABRASIVE ELEMENTS

(76) Inventors: Roy Derrick Achilles, 608 San Martinho, Leicester Road, Bedfordview, Gauteng (ZA); Bronwyn Annette Roberts, 94 18th Street, Parkhurst, Gauteng (ZA); Imraan Parker, 65 Doreen Road, Rylands Estate, Cape Town (ZA); Brett Lancaster, 59 Columbus Road, East Village, Sunward Park, Boksburg, Gauteng (ZA); Klaus Tank, 9 Warbleton Avenue, Essexwold, Johannesburg, Gauteng (ZA)

( * ) Notice: Subject to any disclaimer, the term of this patent is extended or adjusted under 35 U.S.C. 154(b) by 297 days.

(21) Appl. No.: 11/007,261

(22) Filed: Dec. 9, 2004

(65) Prior Publication Data

US 2005/0139397 A1 Jun. 30, 2005

(30) Foreign Application Priority Data

Dec. 11, 2003 (ZA) ..... 2003/09629

(51) Int. Cl.
*B32B 9/00* (2006.01)

(52) U.S. Cl. ..... 428/408; 51/307; 51/309; 428/325

(58) Field of Classification Search ..... 428/408, 428/325; 51/307, 309
See application file for complete search history.

(56) References Cited

U.S. PATENT DOCUMENTS 4,171,973 A * 10/1979 Hara et al. ..... 51/307
5,011,514 A * 4/1991 Cho et al. ..... 51/309
5,120,327 A * 6/1992 Dennis ..... 407/119
5,370,195 A * 12/1994 Keshavan et al. ..... 175/426
5,560,716 A * 10/1996 Tank et al. ..... 428/408
5,601,477 A * 2/1997 Bunting et al. ..... 451/59
5,645,617 A * 7/1997 Frushour ..... 51/309
5,706,906 A * 1/1998 Jurewicz et al. ..... 175/428
5,766,394 A * 6/1998 Anderson et al. ..... 51/307
5,803,196 A * 9/1998 Fielder ..... 175/431
5,890,552 A * 4/1999 Scott et al. ..... 175/426
6,006,846 A * 12/1999 Tibbitts et al. ..... 175/428
6,050,354 A * 4/2000 Pessier et al. ..... 175/430
6,063,149 A * 5/2000 Zimmer ..... 51/295
6,063,333 A * 5/2000 Dennis ..... 419/6
6,068,913 A * 5/2000 Cho et al. ..... 428/212
6,149,695 A * 11/2000 Adia et al. ..... 51/307
6,290,008 B1 * 9/2001 Portwood et al. ..... 175/434
6,332,503 B1 * 12/2001 Pessier et al. ..... 175/430
6,344,149 B1 * 2/2002 Oles ..... 216/11

(Continued)

FOREIGN PATENT DOCUMENTS

EP 1 190791 * 3/2002

(Continued)

*Primary Examiner*—A. T.
(74) *Attorney, Agent, or Firm*—Oblon, Spivak, McClelland, Maier & Neustadt, P.C.

(57) ABSTRACT

A polycrystalline diamond abrasive element, particularly a cutting element, comprises a layer of polycrystalline diamond having a working surface and bonded to a substrate, particularly a cemented carbide substrate, along an interface. The polycrystalline diamond abrasive element is characterized by using a binder phase that is homogeneously distributed through the polycrystalline diamond layer and that is of a fine scale. The polycrystalline diamond also has a region adjacent the working surface lean in catalyzing material and a region rich in catalyzing material.

18 Claims, 1 Drawing Sheet

U.S. PATENT DOCUMENTS

| | | | | |
|---|---|---|---|---|
| 6,397,958 | B1 * | 6/2002 | Charles et al. | 175/391 |
| 6,544,308 | B2 * | 4/2003 | Griffin et al. | 51/309 |
| 6,592,985 | B2 * | 7/2003 | Griffin et al. | 428/212 |
| 6,800,095 | B1 * | 10/2004 | Pope et al. | 428/408 |
| 2006/0060391 | A1 * | 3/2006 | Eyre et al. | 175/434 |
| 2007/0181348 | A1 * | 8/2007 | Lancaster et al. | 175/432 |

FOREIGN PATENT DOCUMENTS

| | | | |
|---|---|---|---|
| JP | 59-219500 | * | 12/1984 |
| RU | 2034937 | * | 5/1995 |
| RU | 566439 | * | 1/2000 |

* cited by examiner

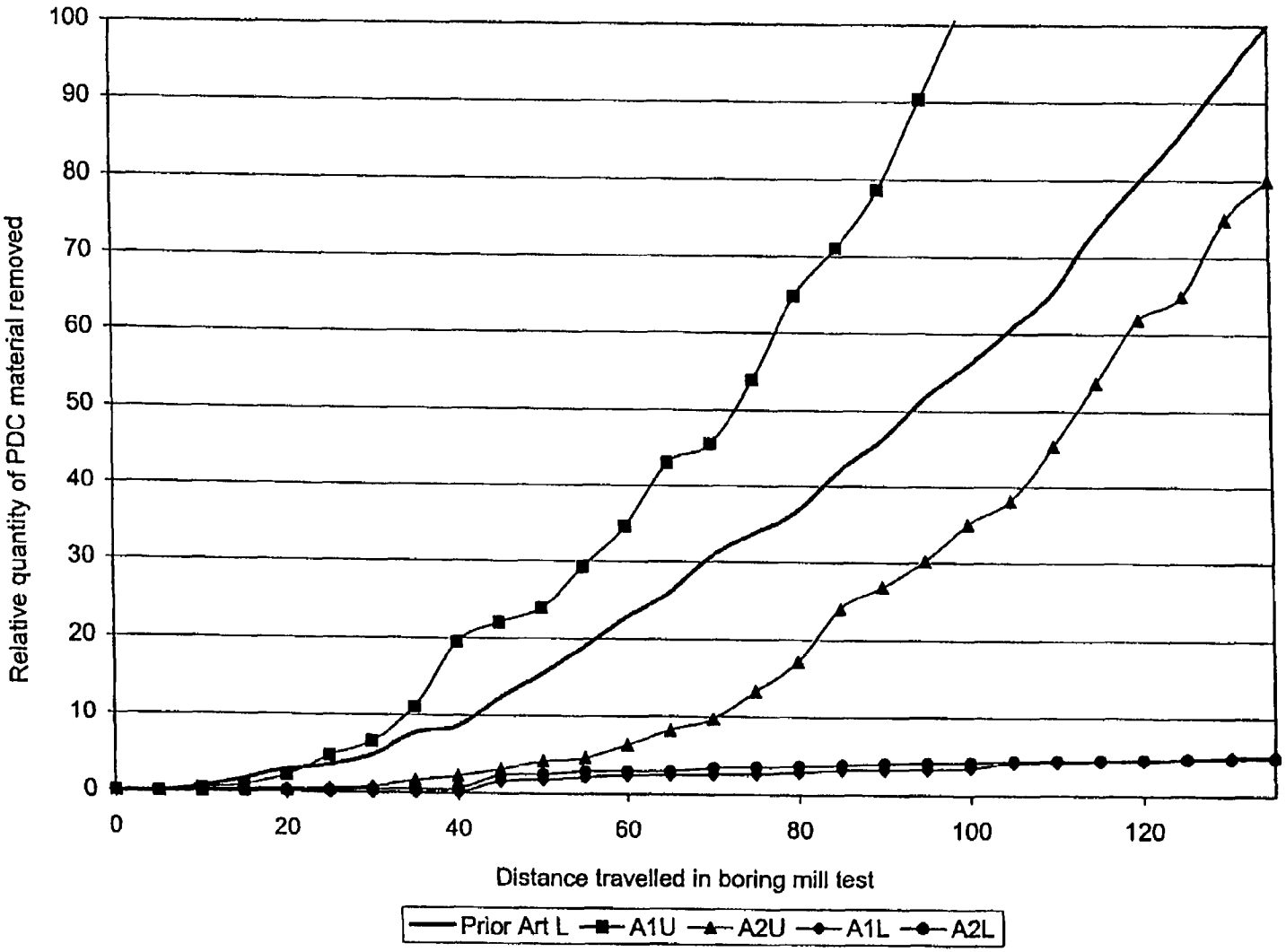
Relative quantity of PDC material removed
100
90
80
70
60
50
40
30
20
10
0
0
20
40
60
80
100
120
Distance travelled in boring mill test
Prior Art L
A1U
A2U
A1L
A2L

POLYCRYSTALLINE DIAMOND ABRASIVE ELEMENTS

BACKGROUND OF THE INVENTION

This invention relates to tool inserts and more particularly to cutting tool inserts for use in drilling and coring holes in subterranean formations.

A commonly used cutting tool insert for drill bits is one which comprises a layer of polycrystalline diamond (PCD) bonded to a cemented carbide substrate. The layer of PCD presents a working face and a cutting edge around a portion of the periphery of the working surface.

Polycrystalline diamond, also known as a diamond abrasive compact, comprises a mass of diamond particles containing a substantial amount of direct diamond-to-diamond bonding. Polycrystalline diamond will generally have a second phase which contains a diamond catalyst/solvent such as cobalt, nickel, iron or an alloy containing one or more such metals.

In drilling operations, such a cutting tool insert is subjected to heavy loads and high temperatures at various stages of its life. In the early stages of drilling, when the sharp cutting edge of the insert contacts the subterranean formation, the cutting tool is subjected to large contact pressures. This results in the possibility of a number of fracture processes such as fatigue cracking being initiated.

As the cutting edge of the insert wears, the contact pressure decreases and is generally too low to cause high energy failures. However, this pressure can still propagate cracks initiated under high contact pressures; and can eventually result in spalling-type failures.

In the drilling industry, PCD cutter performance is determined by a cutter's ability to both achieve high penetration rates in increasingly demanding environments, and still retain a good condition post-drilling (hence enabling re-use). In any drilling application, cutters may wear through a combination of smooth, abrasive type wear and spalling/chipping type wear. Whilst a smooth, abrasive wear mode is desirable because it delivers maximum benefit from the highly wear-resistant PCD material, spalling or chipping type wear is unfavourable. Even fairly minimal fracture damage of this type can have a deleterious effect on both cutting life and performance.

With spalling-type wear, cutting efficiency can be rapidly reduced as the rate of penetration of the drill bit into the formation is slowed. Once chipping begins, the amount of damage to the diamond table continually increases, as a result of the increased normal force now required to achieve a given depth of cut. Therefore, as cutter damage occurs and the rate of penetration of the drill bit decreases, the response of increasing weight on bit can quickly lead to further degradation and ultimately catastrophic failure of the chipped cutting element.

In optimising PCD cutter performance increasing wear resistance (in order to achieve better cutter life) is typically achieved by manipulating variables such as average diamond grain size, overall catalyst/solvent content, diamond density and the like. Typically, however, as PCD material is made more wear resistant it becomes more brittle or prone to fracture. PCD elements designed for improved wear performance will therefore tend to have poor impact strength or reduced resistance to spalling. This trade-off between the properties of impact resistance and wear resistance makes designing optimised PCD structures, particularly for demanding applications, inherently self-limiting.

If the chipping behaviors of more wear resistant PCD can be eliminated or controlled, then the potentially improved performance of these types of a PCD cutters can be more fully realised.

Previously, modification of the cutting edge geometry by bevelling was perceived to be a promising approach to reducing this chipping behaviour.

It has been shown (U.S. Pat. No. 5,437,343 and U.S. Pat. No. 5,016,718) that pre-bevelling or rounding the cutting edge of the PCD table significantly reduces the spalling tendency of the diamond cutting table. This rounding, by increasing the contact area, reduces the effect of the initial high stresses generated during loading when the insert contacts the earthen formation. However, this chamfered edge wears away during use of the PCD cutter and eventually a point is reached where no bevel remains. At this point, the resistance of the cutting edge to spalling-type wear will be reduced to that of the unprotected/unbevelled PCD material.

U.S. Pat. No. 5,135,061 suggests that spalling-type behaviour can also be controlled by manufacturing the cutter with the cutting face formed of a layer of PCD material which is less wear resistant than the underlying PCD material(s), hence reducing its tendency to spall. The greater wear of the less wear resistant layer in the region of the cutting edge provides a rounded edge to the cutting element where it engages the formation. The rounding of the cutting edge achieved by this invention hence has a similar anti-spalling effect to bevelling. The advantages of this approach can be significantly outweighed by the technical difficulty of achieving a satisfactorily thin, less wear resistant layer in situ during the synthesis process. (The consistent and controlled behaviour of this anti-spalling layer is obviously highly dependant on the resultant geometry). In addition, the reduced wear resistance of this upper layer can begin to compromise the overall wear resistance of the cutter—resulting in a more rapid bluntening of the cutting edge and sub-optimal performance.

JP 59119500 claims an improvement in the performance of PCD sintered materials after a chemical treatment of the working surface. This treatment dissolves and removes the catalyst/solvent matrix in an area immediately adjacent to the working surface. The invention is claimed to increase the thermal resistance of the PCD material in the region where the matrix has been removed without compromising the strength of the sintered diamond.

A PCD cutting element has recently been introduced on to the market which is said to have improved wear resistance without loss of impact strength. United States Patents U.S. Pat. Nos. 6,544,308 and 6,562,462 describe the manufacture and behaviour of such cutters. The PCD cutting element is characterised inter alia by a region adjacent the cutting surface which is substantially free of catalysing material. The improvement of performance of these cutters is ascribed to an increase in the wear resistance of the PCD in this area; where the removal of the catalyst material results in decreased thermal degradation of the PCD in the application.

SUMMARY OF THE INVENTION

According to the present invention, there is provided a polycrystalline diamond abrasive element, particularly a cutting element, comprising a layer of polycrystalline diamond, which has a binder phase containing catalysing material, having a working surface and bonded to a substrate, particularly a cemented carbide substrate, along an interface, the polycrystalline diamond abrasive element being characterised by the binder phase being homogeneously distributed through the polycrystalline diamond layer and being of a fine scale and the polycrystalline diamond having a region adjacent the working surface lean in catalysing material and a region rich in catalysing material.

The distribution of the binder phase thicknesses or mean free path measurements in the microstructure has an average which is preferably less than 6 μm, more preferably less than 4.5 μm and most preferably less than 3 μm.

In addition, the standard deviation of the distribution of the binder phase thicknesses, expressed as a percentage of the average binder phase thickness, is less than 80%, more preferably less than 70%, and most preferably less than 60%.

Where the distribution of the binder phase can be expressed in terms of an "equivalent circle diameter", the standard deviation of the distribution of circle diameters, expressed as a percentage of the average circle diameter, is preferably less than 80%, more preferably less than 70%, and most preferably less than 60%.

Due to the homogeneous distribution and fine scale of the binder phase, also referred to as the catalyst/solvent matrix, the polycrystalline diamond is of a "high grade".

In addition, the "high grade" polycrystalline diamond is a polycrystalline diamond material characterized by one or more of the following:

1) having an average diamond particle grain size of less than 20 microns, preferably less than 15 microns, even more preferably less than about 11 microns;
2) a very high wear resistance i.e. a wear resistance which is sufficiently high to render a polycrystalline diamond abrasive element using such a material, in the absence of a region adjacent the working surface lean in catalysing material, highly susceptible to spalling or chipping type wear; and
3) a wear ratio, being the percentage ratio of the quantity of material removed from a polycrystalline diamond abrasive element having a region adjacent the working surface lean in catalysing material relative to the size of the wear scar of or the quantity of material removed from a polycrystalline diamond abrasive element, made of the same grade polycrystalline diamond, but in the absence of a region adjacent the working surface lean in catalysing material, of less than 50%, preferably less than 40%, more preferably less than 30%, in the latter stages of a conventional application-based granite boring mill test.

The polycrystalline diamond has a very high wear resistance. This may be achieved, and is preferably achieved in one embodiment of the invention, by producing the polycrystalline diamond from a mass of diamond particles having at least three, and preferably at least five different average particle sizes. The diamond particles in this mix of diamond particles are preferably fine.

In polycrystalline diamond, individual diamond particles are, to a large extent, bonded to adjacent particles through diamond bridges or necks. The individual diamond particles retain their identity, or generally have different orientations. The average particle size of these individual diamond particles may be determined using image analysis techniques. Images are collected on the scanning electron microscope and are analysed using standard image analysis techniques. From these images, it is possible to extract a representative diamond particle size distribution.

The polycrystalline diamond layer has a region adjacent the working surface which is lean in catalysing material. Generally, this region will be substantially free of catalysing material. The region will extend into the polycrystalline diamond from the working surface generally to a depth of as low as about 30 μm to no more than about 500 microns.

The polycrystalline diamond also has a region rich in catalysing material. The catalysing material is present as a sintering agent in the manufacture of the polycrystalline diamond layer. Any diamond catalysing material known in the art may be used. Preferred catalysing materials are Group VIII transition metals such as cobalt and nickel. The region rich in catalysing material will generally have an interface with the region lean in catalysing material and extend to the interface with the substrate.

The region rich in catalysing material may itself comprise more than one region. The regions may differ in average particle size, as well as in chemical composition. These regions, when provided, will generally lie in planes parallel to the working surface of the polycrystalline diamond layer.

According to another aspect of the invention, a method of producing a PCD abrasive element as described above includes the steps of creating an unbonded assembly by providing a substrate, placing a mass of diamond particles and a binder phase on a surface of the substrate, the binder phase being arranged such that it is homogeneously distributed in the unbonded assembly, and providing a source of catalysing material for the diamond particles, subjecting the unbonded assembly to conditions of elevated temperature and pressure suitable for producing a polycrystalline diamond layer of the mass of diamond particles, such layer being bonded to the substrate, and removing catalysing material from a region of the polycrystalline diamond layer adjacent an exposed surface thereof.

The substrate will generally be a cemented carbide substrate. The source of catalysing material will generally be the cemented carbide substrate. Some additional catalysing material may be mixed in with the diamond particles.

The diamond particles contain particles having different average particle sizes. The term "average particle size" means that a major amount of particles will be close to the particle size, although there will be some particles above and some particles below the specified size. The peak and distribution of the particles will have the specified size. Thus, for example, if the average particle size is 10 microns, there will be some particles that are larger and some particles which are smaller than 10 microns, but the major amount of the particles will be at approximately 10 microns in size and a peak in the distribution of the particles will be 10 microns.

The mass of diamond particles may have regions or layers that differ from each other in their mix of diamond particles. Thus, there may be a region or layer containing particles having at least five different average particle sizes on a region or layer that has particles having at least four different average particle sizes.

Catalysing material is removed from a region of the polycrystalline diamond layer adjacent an exposed surface thereof. Generally, that surface will be on a side of the polycrystalline layer opposite to the substrate and will provide a working surface for the polycrystalline diamond layer. Removal of the catalysing material may be carried out using methods known in the art such as electrolytic etching, acid leaching and evaporation techniques.

The conditions of elevated temperature and pressure necessary to produce the polycrystalline diamond layer from a mass of diamond particles are well known in the art. Typically, these conditions are pressures in the range 4 to 8 GPa and temperatures in the range 1300 to 1700° C.

It has been found that the PCD abrasive elements of the invention have significantly improved wear behaviour, as a result of controlling the spalling and chipping wear component, than PCD abrasive elements of the prior art.

BRIEF DESCRIPTION OF THE DRAWING

The accompanying drawing is a graph showing comparative data in a boring mill test using different polycrystalline diamond cutting elements.

DETAILED DESCRIPTION OF THE INVENTION

The polycrystalline diamond abrasive elements of the invention have particular application as cutter elements for drill bits. In this application, they have been found to have excellent wear resistance and impact strength without being susceptible to spalling or chipping. These properties allow them to be used effectively in drilling or boring of subterranean formations having high compressive strength.

A polycrystalline diamond layer is bonded to a substrate. The polycrystalline diamond layer has an upper working surface around which is a peripheral cutting edge. The polycrystalline diamond layer has a region rich in catalysing material and a region lean in catalysing material. The region lean in catalysing material extends from the working surface into the polycrystalline diamond layer. The depth of this region will typically be no more than about 500 microns, and is preferably from about 30 to about 400 microns, most preferably from about 60 to about 350 microns. Typically, if the PCD edge is bevelled, the region lean in catalysing material will generally follow the shape of this bevel and extend along the length of the bevel. The balance of the polycrystalline layer extending to the cemented carbide substrate is the region rich in catalysing material. In addition, the surface of the PCD element may be mechanically polished so as to achieve a low-friction surface or finish.

Generally, the layer of polycrystalline diamond will be produced and bonded to the cemented carbide substrate in a HPHT process. In so doing, it is important to ensure that the binder phase and diamond particles are arranged such that the binder phase is distributed homogeneously and is of a fine scale.

The homogeneity or uniformity of the structure is defined by conducting a statistical evaluation of a large number of collected images. The distribution of the binder phase, which is easily distinguishable from that of the diamond phase using electron microscopy, can then be measured in a method similar to that disclosed in EP 0974566. This method allows a statistical evalution of the average thicknesses of the binder phase along several arbitrarily drawn lines through the microstructure. This binder thickness measurement is also referred to as the "mean free path" by those skilled in the art. For two materials of similar overall composition or binder content and average diamond grain size, the material which has the smaller average thickness will tend to be more homogenous, as this implies a "finer scale" distribution of the binder in the diamond phase. In addition, the smaller the standard deviation of this measurement, the more homogenous is the structure. A large standard deviation implies that the binder thickness varies widely over the microstructure, i.e. that the structure is not even, but contains widely dissimilar structure types.

Another parallel technique, known as "equivalent circle diameter", estimates a circle equivalent in size for each individual microscopic area identified to be binder phase in the microstructure. The collected distribution of these circles is then evaluated statistically. In much the same way as for the mean free path technique, the larger the standard deviation of this measurement, the less homogenous is the structure. These two image analysis techniques combine well to give an overall picture of the homogeneity of the microstructure.

The diamond particles will preferably comprise a mix of diamond particles, differing in average particle sizes. In one embodiment, the mix comprises particles having five different average particle sizes as follows:

| Average Particle Size (in microns) | Percent by mass |
|---|---|
| 20 to 25 (preferably 22) | 25 to 30 (preferably 28) |
| 10 to 15 (preferably 12) | 40 to 50 (preferably 44) |
| 5 to 8 (preferably 6) | 5 to 10 (preferably 7) |
| 3 to 5 (preferably 4) | 15 to 20 (preferably 16) |
| less than 4 (preferably 2) | Less than 8 (preferably 5) |

In another embodiment, the polycrystalline diamond layer comprises two layers differing in their mix of particles. The first layer, adjacent the working surface, has a mix of particles of the type described above. The second layer, located between the first layer and the substrate, is one in which (i) the majority of the particles have an average particle size in the range 10 to 100 microns, and consists of at least three different average particle sizes and (ii) at least 4 percent by mass of particles have an average particle size of less than 10 microns. Both the diamond mixes for the first and second layers may also contain admixed catalyst material.

Once the polycrystalline diamond abrasive element is formed, catalysing material is removed from the working surface of the particular embodiment using any one of a number of known methods. One such method is the use of a hot mineral acid leach, for example a hot hydrochloric acid leach. Typically, the temperature of the acid will be about 110° C. and the leaching times will be 3 to 60 hours. The area of the polycrystalline diamond layer which is intended not to be leached and the carbide substrate will be suitably masked with acid resistant material.

Two polycrystalline diamond cutter elements of the bilayer type described above were produced on respective cemented carbide substrates. These polycrystalline diamond cutter elements will be designated "A1U" and "A2U", respectively.

A further two polycrystalline diamond elements were produced on respective cemented carbide substrates using the same diamond mixes used in producing the polycrystalline diamond layers in A1U and A2U. These polycrystalline diamond cutter elements will be designated "A1L" and "A2L", respectively.

Each of the polycrystalline diamond elements A1L and A2L had catalysing material, in this case cobalt, removed from the working surface thereof to create a region lean in catalysing material. This region extended below the working surface to an average depth of about 250 μm. Typically, the range for this depth will be +/−40 μm, giving a range of 210-290 μm for the region lean in catalysing material across a single cutter.

The cutter elements A1U, A2U, A1L and A2L were then compared in a vertical boring mill test with a commercially available polycrystalline diamond cutter element having a region immediately below the working surface lean in catalyzing material. In this test, the relative quantity of PDC material removed was measured as a function of the distance traveled by the cutter element boring into the workpiece, which in this case was SW granite, in a boring mill test. The results obtained are illustrated graphically by the Figure.

The commercially available polycrystalline diamond cutting element is designated as "Prior Art 1L". It will be noted from the Figure that a much larger quantity of PDC material was removed from the prior art cutter element and the reference cutters A1U and A2U than the cutter elements A1L and A2L of the invention in the latter stages of the test. In the case of A1U and A2U, the greater quantity of PDC material removed is ascribed to spalling/chipping type wear due to their inherent high wear resistance. This will necessitate an increase in weight on bit in order to achieve an acceptable rate of cutting. This in turn induces higher stresses within the cutter elements, resulting in a further reduction in life. Even after extended boring, the cutter elements A1L and A2L had not had significant quantities of PDC material removed.

The spread of behaviours in the reference untreated cutters A1U and A2U is not unexpected and can be attributed to the stochastic nature of the spalling type failure that these cutters undergo. This behaviour is typical where a spalling/chipping material removal mechanism dominates. By contrast, A1L and A2L show very similar wear progression, indicating that a smooth type wear is the dominant mechanism after carrying out the treatment.

The microstructures of the cutters employed in this test were assessed using a scanning electron microscope. The microstructural parameters measured were as set out in Table 1.

TABLE 1

| Cutter | A1 (U and L) | A2 (U and L) | Prior Art L |
|---|---|---|---|
| Binder content distribution | | | |
| Area (%) | 8.53% | 8.75% | 8.28% |
| σ* (%) | 0.35% | 0.40% | 0.69% |
| Binder thickness (or mean free path) distribution | | | |
| Average (μm) | 2.10 | 2.17 | 10.8 |
| σ* (μm) | 0.98 | 1.17 | 9.00 |
| σ* (expressed as % of average) | 46% | 54% | 83% |
| Binder "equivalent circle diameter" distribution | | | |
| Average | 1.94 | 2.03 | 3.76 |
| σ* (μm) | 1.06 | 0.87 | 4.07 |
| σ* (expressed as % of average) | 55% | 43% | 108% |

σ* is the statistical standard deviation of the distribution

We claim:

1. A polycrystalline diamond abrasive element, comprising:

a layer of polycrystalline diamond comprising a binder phase comprising catalyzing material, and a substrate, wherein said layer of the polycrystalline diamond comprises a working surface and is bonded to the substrate along an interface, a region adjacent said working surface which is lean in the catalyzing material, and a region rich in the catalyzing material, wherein said region rich in the catalyzing material comprises said binder phase homogeneously distributed through the rich region, and a fine scale of the binder phase distribution, wherein the binder phase distribution is expressed in terms of an equivalent circle diameter, the standard deviation of the distribution of equivalent circle diameters, expressed as a percentage of the average equivalent circle diameter, is less than 80%, and wherein the layer of the polycrystalline diamond comprises diamond particles having an average particle grain size of less than 20 microns.

2. The polycrystalline diamond abrasive element according to claim 1, wherein the standard deviation of the distribution of equivalent circle diameters, expressed as a percentage of the average equivalent circle diameter, is less than 70%.

3. The polycrystalline diamond abrasive element according to claim 1, wherein the standard deviation of the distribution of equivalent circle diameters, expressed as a percentage of the average equivalent circle diameter, is less than 60%.

4. The polycrystalline diamond abrasive element according to claim 1, wherein the layer of the polycrystalline diamond comprises the diamond particles having an average particle grain size of less than 15 microns.

5. The polycrystalline diamond abrasive element according to claim 4, wherein the layer of the polycrystalline diamond comprises the diamond particles having an average particle grain size of less than 11 microns.

6. The polycrystalline diamond abrasive element according to claim 1, wherein the polycrystalline diamond abrasive element has a wear ratio-of less than 50%.

7. The polycrystalline diamond abrasive element according to claim 6, wherein the polycrystalline diamond abrasive element has a wear ratio of less than 40%.

8. The polycrystalline diamond abrasive element according to claim 7, wherein the polycrystalline diamond abrasive element has a wear ratio of less than 30%.

9. The polycrystalline diamond abrasive element according to claim 1, wherein the layer of the polycrystalline diamond is produced from a mass of diamond particles having at least three different average particle sizes.

10. The polycrystalline diamond abrasive element according to claim 9, wherein the layer of the polycrystalline diamond is produced from a mass of diamond particles having at least five different average particle sizes.

11. The polycrystalline diamond abrasive element according to claim 1, which is a cutting element.

12. The polycrystalline diamond abrasive element according to claim 1, wherein the substrate is a cemented carbide substrate.

13. The polycrystalline diamond abrasive element according to claim 1, wherein the region lean in catalyzing material extends into the layer of the polycrystalline diamond from the working surface to a depth of from about 30 microns to about 500 microns.

14. The polycrystalline diamond abrasive element according to claim 13, wherein the region lean in catalyzing material extends to a depth of from about 60 microns to about 350 microns.

15. The polycrystalline diamond abrasive element according to claim 1, wherein the working surface of the layer of the polycrystalline diamond defines a cutting edge that is beveled.

16. The polycrystalline diamond abrasive element according to claim 15, wherein the region lean in catalyzing material follows the beveled cutting edge.

17. The polycrystalline diamond abrasive element of claim 1, wherein the region rich in the catalyzing material extends from the region lean in the catalyzing material to the interface with the substrate.

18. The polycrystalline diamond abrasive element of claim 1, wherein a difference between the average particle sizes of the diamond particles of the layer of the polycrystalline diamond is not more than 25 μm.

* * * * *